US006634931B2

(12) United States Patent
Ayyagari et al.

(10) Patent No.: US 6,634,931 B2
(45) Date of Patent: Oct. 21, 2003

(54) DRY POLISHING OF INTRAOCULAR LENSES

(75) Inventors: Madhu Ayyagari, Fairport, NY (US); Mahendra P. Nandu, Rochester, NY (US)

(73) Assignee: Bausch & Lomb Surgical, Inc., Claremont, CA (US)

( * ) Notice: Subject to any disclaimer, the term of this patent is extended or adjusted under 35 U.S.C. 154(b) by 0 days.

(21) Appl. No.: 09/734,439

(22) Filed: Dec. 11, 2000

(65) Prior Publication Data

US 2002/0072305 A1 Jun. 13, 2002

(51) Int. Cl.[7] ..... B24B 1/00
(52) U.S. Cl. ..... 451/41; 451/35; 451/104
(58) Field of Search ..... 451/32, 35, 104, 451/113, 326, 41, 328, 329, 330

(56) References Cited

U.S. PATENT DOCUMENTS

| | | | | |
|---|---|---|---|---|
| 2,084,427 A | | 6/1937 | Broderson | |
| 2,380,653 A | | 7/1945 | Kopplin | |
| 2,387,034 A | | 10/1945 | Milano | |
| 3,030,746 A | | 4/1962 | Firestine et al. | |
| 4,485,061 A | | 11/1984 | Akhavi et al. | 264/161 |
| 4,541,206 A | | 9/1985 | Akhavi | 51/217 |
| 4,551,949 A | * | 11/1985 | Akhavi et al. | 451/32 |
| 4,580,371 A | | 4/1986 | Akhavi | 51/313 |
| 5,133,159 A | | 7/1992 | Nelson | 51/313 |
| 5,571,558 A | | 11/1996 | Nguyen | 427/215 |
| 5,586,925 A | * | 12/1996 | DiNorcia, Sr. et al. | 451/35 |
| 5,649,988 A | | 7/1997 | Valle et al. | 65/35 |
| 5,653,625 A | * | 8/1997 | Pierce et al. | 451/326 |
| 5,725,811 A | | 3/1998 | Nguyen et al. | 264/2.7 |
| 5,961,370 A | * | 10/1999 | Valle et al. | 451/32 X |
| 6,254,466 B1 | * | 7/2001 | Mucciacciaro et al. | 451/32 X |

FOREIGN PATENT DOCUMENTS

WO 02/16077A2(3) 2/2002 ..... B24B/31/10

* cited by examiner

*Primary Examiner*—Joseph J. Hail, III
*Assistant Examiner*—Anthony Ojini

(57) ABSTRACT

A process of dry polishing molded or lathe cut intraocular lenses to removing flash, sharp edges and/or surface irregularities therefrom. The process includes rotational tumbling of partially protected intraocular lenses in a dry polishing media. The process is suitable for single piece and multipiece intraocular lenses of varying composition.

21 Claims, 4 Drawing Sheets

DRY POLISHING OF INTRAOCULAR LENSES

FIELD OF THE INVENTION

The present invention relates to methods of polishing intraocular lenses. More specifically, the present invention relates to methods of dry polishing intraocular lenses in a bed of particles to remove flash, surface irregularities and/or sharp edges from molded or lathe cut surfaces thereof.

BACKGROUND OF THE INVENTION

Methods of molding articles from moldable materials have been known for some time. A common problem associated with molding techniques is the formation of excess material or flash on the edges of the molded article. Depending on the type of article formed in the molding process and the manner in which the article is used, the presence of excess material or flash can be undesirable. The same is also true of rough, irregular or sharp edges found on articles produced through a lathing process.

Many medical devices, such as for example intraocular lens implants, require highly polished surfaces free of sharp edges or surface irregularities. In the case of intraocular lenses (IOLs), the lens is in direct contact with delicate eye tissues. Any rough or non-smooth surface on an IOL may cause irritation or abrading of tissue or other similar trauma to the eye. It has been found that even small irregularities can cause irritation to delicate eye tissues.

Various methods of polishing are known in the art. U.S. Pat. Nos. 2,084,427 and 2,387,034 disclose methods of making plastic articles such as buttons that include tumbling the articles to remove projections of excess material or flash.

U.S. Pat. No. 2,380,653 discloses a cold temperature tumbling process to remove flash from a molded article. This method requires the article to be tumbled in a rotatable container of dry ice and small objects such as wooden pegs. The cold temperature resulting from the dry ice renders the flash material relatively brittle, such that the flash is more easily broken from the article during the tumbling process.

U.S. Pat. No. 3,030,746 discloses a grinding and polishing method for optical glass, including glass lenses. The method includes tumbling the glass articles in a composition of liquid, abrasive and small pellets or media. The liquid is disclosed as being water, glycerins, kerosene, light mineral oil and other organic liquids either alone or in combination. The abrasive component is described as being garnet, corundum, boron carbide, quartz, aluminum oxide, emery or silicon carbide. The media is disclosed as being ceramic cones, plastic slugs, plastic molding, powder, limestone, synthetic aluminum oxide chips, maple shoe pegs, soft steel diagonals, felt, leather, corn cobs, cork or waxes.

U.S. Pat. No. 4,485,061 discloses a method of processing plastic filaments which includes abrasive tumbling to remove excess material.

U.S. Pat. Nos. 4,541,206 and 4,580,371 disclose a lens holder or fixture used for holding a lens in a process of rounding the edge thereof. The process includes an abrasive tumbling step.

U.S. Pat. No. 5,133,159 discloses a method of tumble polishing silicone articles in a receptacle charged with a mixture of non-abrasive polishing beads and a solvent which is agitated to remove surface irregularities from the articles.

U.S. Pat. No. 5,571,558 discloses a tumbling process for removing flash from a molded IOL by applying a layer of aluminum oxide on a plurality of beads, placing the coated beads, alcohol, water and silicone IOLs in a container and tumbling the same to remove flash.

U.S. Pat. No. 5,725,811 discloses a process for removing flash from molded IOLs including tumbling the IOLs in a tumbling media of 0.5 mm diameter glass beads and 1.0 mm diameter glass beads, alcohol and water.

Prior methods of removing flash or surface irregularities, such as described above, may be inadequate or impractical in the manufacture of certain types of IOLs. For example, certain IOLs formed from relatively soft, highly flexible material, such as silicone, are susceptible to chemical and/or physical changes when subjected to cold temperatures. For this reason, certain types of cryo-tumbling or cold temperature tumbling may be impractical in the manufacture of IOLs made from such materials. Additionally, certain types of abrasive tumbling processes may be suitable for harder lens material, such as glass or polymethylmethacrylate (PMMA), but may not be suitable for softer lens materials. Also, most tumbling processes known in the art require the lens to be submersed in a liquid that may not be suitable for some lens materials or manufacturing processes. Accordingly, a need exists for a suitable process for removing flash and/or irregularities from molded or lathe cut IOLs made of various materials.

SUMMARY OF THE INVENTION

The present invention relates to methods for dry polishing IOLs. IOLs are currently either molded in removable molds or lathe cut. Subsequent to these operations, the IOLs have surface roughness or sharp edges that need to be minimized or eliminated. After polishing methods such as tumbling the IOLs in a container with glass beads and a liquid, the IOLs must be dried or in the case of hydrogels dehydrated, prior to further processing. Drying or dehydrating the IOLs can be both expensive and time consuming. The dry polishing methods of the present invention eliminate the need for drying or dehydrating IOLs. This is particularly important in the case of surface coated IOLs where a coating or surface treatment can not be consistently applied in the presence of moisture.

The method of dry polishing IOLs in accordance with the present invention consists of obtaining a tubular IOL container with two opposed open ends and a number of elongated slots corresponding to the maximum number of haptics on the IOLs to be polished. The tubular IOL container is also equipped with preferably two or more clamps extending from the exterior surface of the IOL container. One or more IOLs are positioned within the IOL container as described in more detail below, so that the IOLs' haptics extend from the elongated slots formed in the IOL container. The IOL container with IOLs positioned therein is then removably fixed within a polishing chamber. The polishing chamber and the axially concentric IOL tube are preferably maintained in a horizontal position. A volume of dry polishing medium is placed inside the polishing chamber and the one or more open ends thereof removably sealed. The polishing chamber is then axially rotated. As the polishing chamber is rotated, the polishing medium repeatedly contacts the exposed IOL haptic surfaces thus polishing the same. The duration of tumbling and the number of polishing chamber revolutions per minute can be adjusted to achieve the desired degree of polishing. Since the slots of the IOL container protect the IOL optic peripheral edges, the IOL optic peripheral edges remain unpolished and well defined while the remainder is polished. Well-defined peripheral optic edges are desirable to prevent cellular migration and the development of posterior cellular opacification. Following polishing, the IOLs are removed from the polishing chamber and IOL container. The polished IOLs are then easily handled and surface treated without having to dehydrate or dry the same.

Accordingly, it is an object of the present invention to provide a method for dry polishing lathe cut IOLs.

Another object of the present invention is to provide a method for dry polishing molded IOLs.

Another object of the present invention is to provide a method for polishing IOLs without the use of liquids.

Another object of the present invention is to provide a method for polishing IOLs that eliminates the need to dry or dehydrate the same prior to further processing.

Another object of the present invention is to provide a method for dry polishing IOLs that is suitable for a variety of IOL materials.

Still another object of the present invention is to provide a method for polishing IOLs that allows for consistent surface coating without additional process steps.

These and other objectives and advantages of the present invention, some of which are specifically described and others that are not, will become apparent from the detailed description, drawings and claims that follow, wherein like features are designated by like numerals.

DETAILED DESCRIPTION OF THE INVENTION

Figure 1:
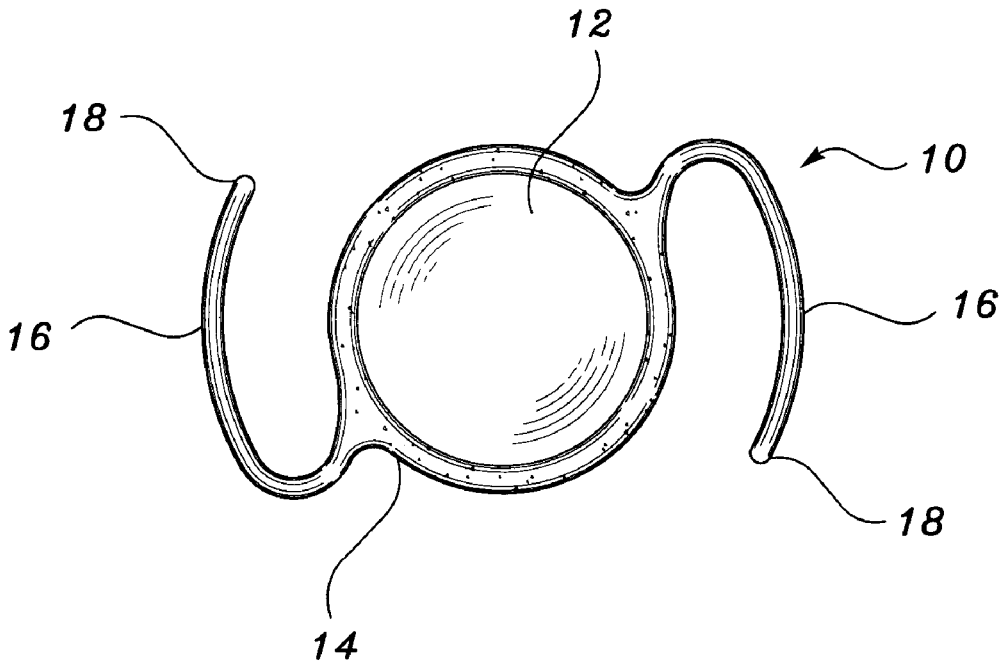
FIG. 1 is a plan view of an intraocular lens with open haptics.
Figure 2:
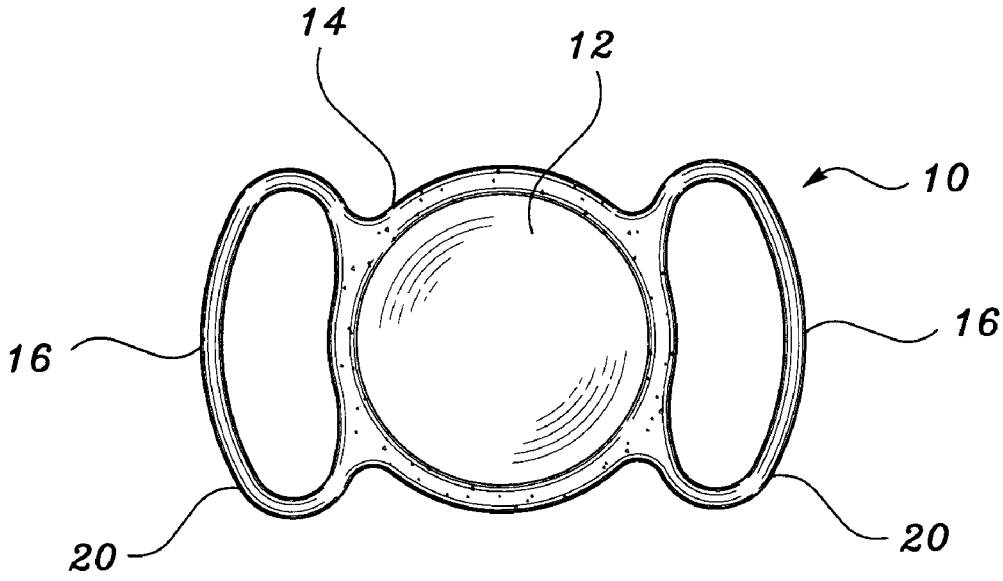
FIG. 2 is a plan view of an intraocular lens with looped haptics.

FIGS. 1 and 2 illustrate typical intraocular lenses (IOLs) 10 produced using dry polishing methods of the present invention. Each IOL 10 typically has an optic portion 12 defined by an outer peripheral edge 14 and one or more but typically two to four haptics 16 of either an open configuration 18 as illustrated in FIG. 1 or a looped configuration 20 as illustrated in FIG. 2. The haptics 16 are integrally formed on outer peripheral edge 14 or permanently attached thereto through processes such as heat, physical staking and/or chemical bonding. The typical IOL 10 may be made from a variety of materials such as but not limited to polymethylmethacrylate (PMMA), silicones, hydrophilic acrylics, hydrophobic acrylics or combinations thereof.

Figure 3:
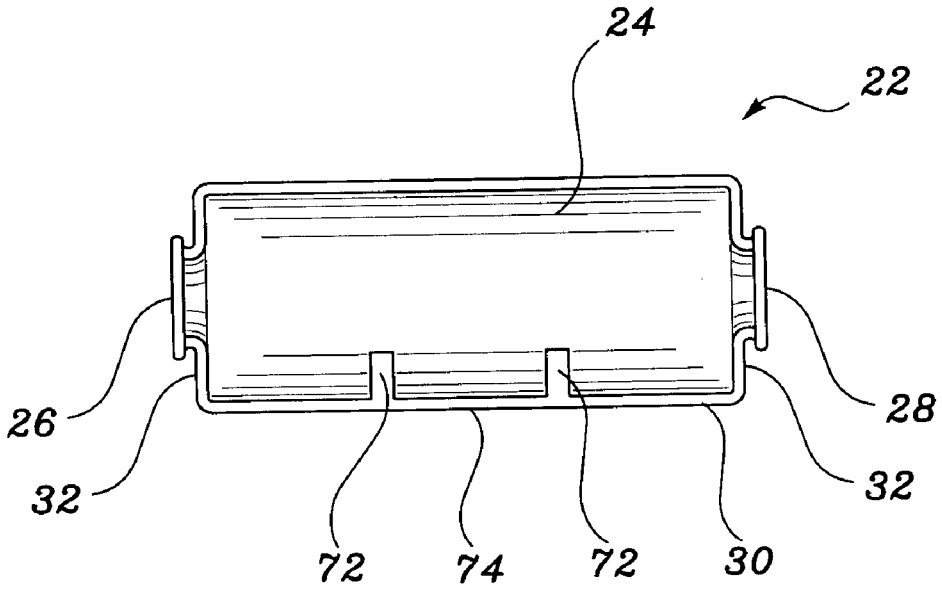
FIG. 3 is a plan view of a polishing chamber of the present invention.
Figure 4:
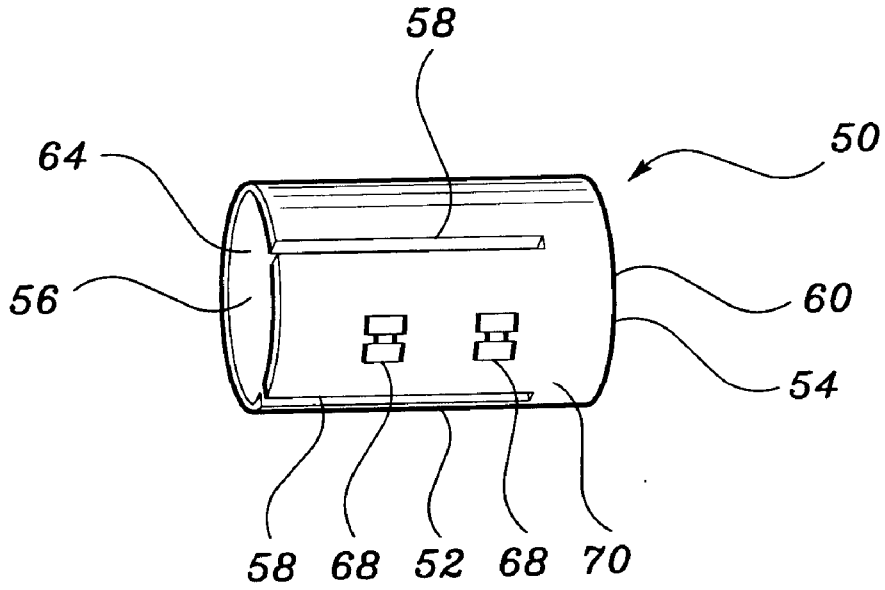
FIG. 4 is a perspective view of the IOL container of the present invention.
Figure 5:
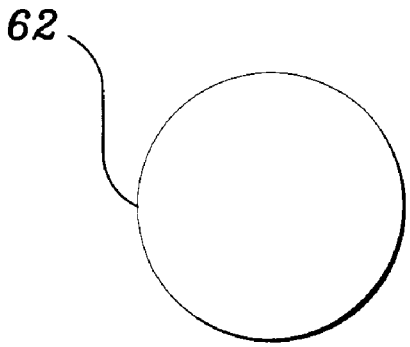
FIG. 5 is a plan view of a retaining disc for use in the IOL container of FIG. 4 with IOLs loaded therein.
Figure 6:
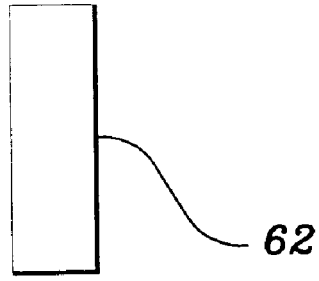
FIG. 6 is a side view of the retaining disc of FIG. 5.
Figure 7:
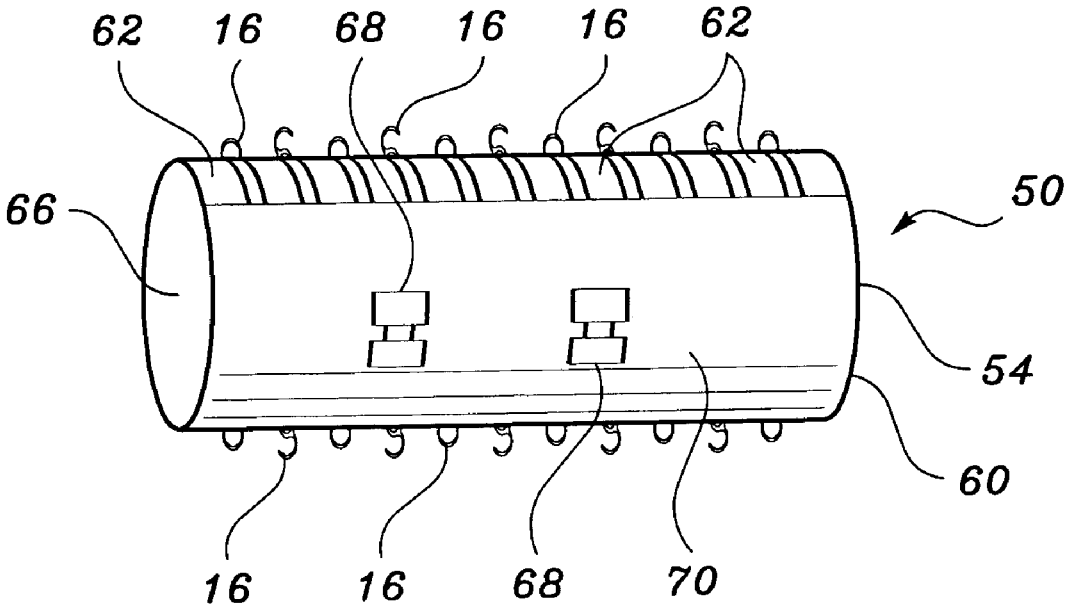
FIG. 7 is a perspective view of the IOL container of FIG. 4 with the intraocular lenses of FIGS. 1 and 2 and the retaining discs of FIG. 5 removably fixed therein.
Figure 8:
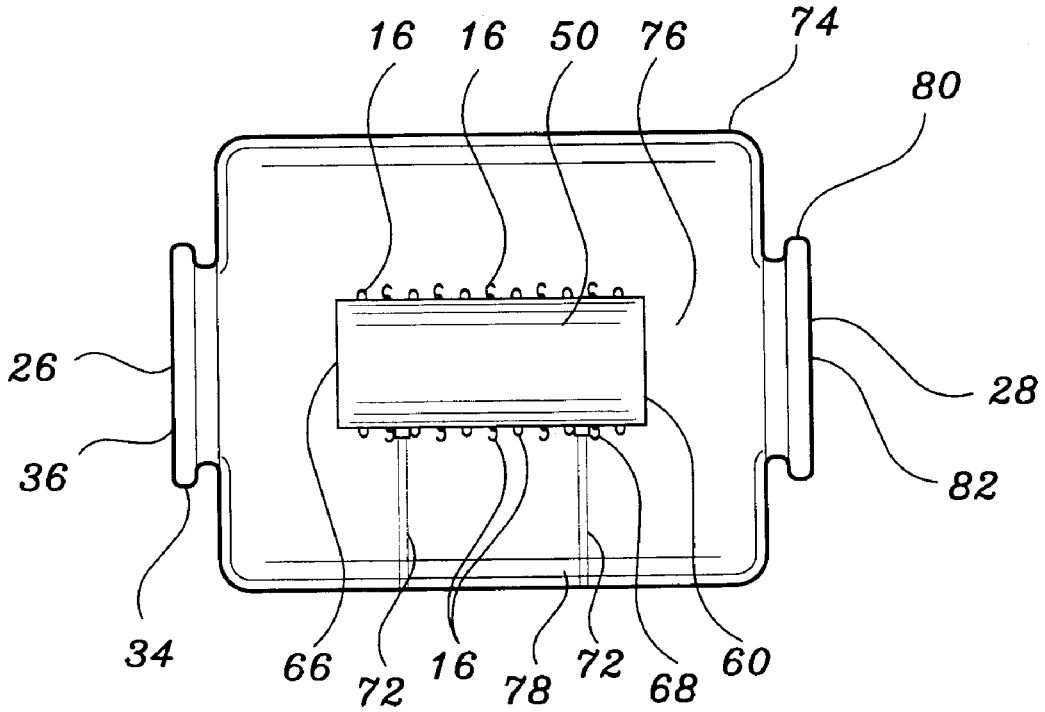
FIG. 8 is a plan view of the polishing chamber of FIG. 3 with the IOL container of FIG. 7 removably fixed therein.
Figure 9:
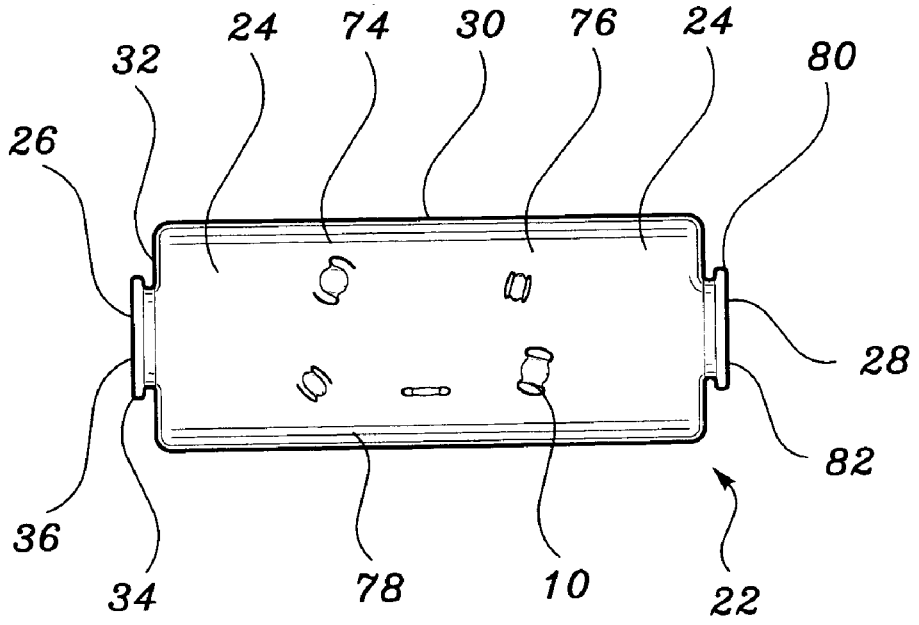
FIG. 9 is a plan view of the polishing chamber of FIG. 3 with the intraocular lenses of FIGS. 1 and 2 removably placed therein.

FIG. 3 illustrates a polishing chamber 22, which may be made of any suitable material such as but not limited to glass, plastic, metal or a combination thereof but preferably, glass for visibility and cleaning ease. Polishing chamber 22 may be of any geometric configuration defining an interior area 24 and having one or more, but preferably two open ends 26 and 28 therein for ease in loading and cleaning the same. Preferably, polishing chamber 22 is of a tubular configuration defined by a tubular body 30 having two opposed open ends 26. and 28. Tubular body 30 may optionally decrease in diameter abruptly to form partial end walls 32 at one or both open ends 26 and/or 28 for increased structural integrity. Open end 26 is defined by an extended rim 34. As illustrated in FIG. 8, extended rim 34 may be removably sealed, by various methods known to those skilled in the art, such as by a snap-fit or a threaded cap 36. If a threaded cap 36 is utilized, extended rim 34 is likewise threaded to be engaged within threaded cap 36. The subject dry polishing method likewise uses an IOL container 50 as illustrated in FIGS. 4, 7 and 8. IOL container 50 may be made of any suitable material such as but not limited to glass, plastic, metal or a combination thereof but preferably glass for function and durability. IOL container 50 is preferably of an elongated tubular shape defined by a body portion 52 with two opposed open ends 54 and 56 and a number of elongated slots 58 extending from open end 56 corresponding to the maximum number of haptics 16 on IOLs 10 to be polished. A retaining rim 60 extends interiorly from open end 54 of body portion 52 thereby creating a smaller diameter opening at open end 54 than that of open end 56. A retaining disk 62, best illustrated in FIGS. 5 and 6, is then inserted within interior 64 of IOL container 50 through open end 56 and positioned to abut retaining rim 60. Suitable materials for the manufacture of retaining disk 62 include natural or synthetic rubber or plastic having a shore hardness less than that of optic 12 of IOL 10 protect the same from damage. An IOL 10 is then placed within interior 64 of IOL container 50 through open end 56 and positioned to abut retaining disk 62 with haptics 16 extending exteriorly from elongated slots 58. A retaining disk 62 is then inserted within interior 64 of IOL container 50 through open end 56 and positioned to abut IOL 10. Loading of IOL container 50 continues with however many IOLs 10 and retaining disks 62 desired until IOL container 50 is full. In loading IOL container 50, a rule is to have at least one more retaining disk 62 than IOLs 10 when the same is full. Once IOL container 50 is completely filled, open end 56 is removably sealed with a snap-fit or threaded cap 66 to retain IOLs 10 and retaining disks 62 within interior 64 of IOL container 50. If open end 56 is removably sealed with a threaded cap 66, exterior surface 57 of open end 56 is likewise threaded for engagement within threaded cap 66. IOL container 50, once loaded and removably sealed is removably fixed within polishing chamber 20 as illustrated in FIG. 8 by snapping rigid clamps 68 formed on exterior surface 70 of IOL container 50 over retaining means 72 formed on interior surface 74 of polishing chamber 22. Once extended rim 34 of open end 26 has been removably sealed with cap 36 and IOL container 50 is removably fixed within polishing chamber 22, interior area 76 defined by interior surface 74 of polishing chamber 22 is then at least partially loaded through open end 28 with polishing media 78. Optionally, open end 26 may be removably sealed with cap 36 and free IOLs 10 placed within polishing chamber 22 interior area 76 before at least partially loading the same with polishing media 78 as illustrated in FIG. 9. Such a method may be used if dry polishing of the entire IOL 10 is desired. Suitable polishing media 78 includes but is not limited to glass beads, silica gel, silica and aluminum oxide whereby silicone and aluminum oxide is preferred due to ready availability at low cost. After filling polishing chamber 22 with polishing media 78, the second open end 28 having an extended rim 80 is removably sealed such as with a snap-fit or threaded cap 82. If a threaded cap 82 is used to removably seal open end 28, extended rim 80 is likewise threaded for engagement within threaded cap 82. If polishing chamber 22 has only one open end 28, interior area 76 is loaded through open end 28 with IOL container 50 and polishing media 78 prior to removably sealing the same with cap 82. Polishing chamber 22 is then placed horizontally between two motor driven closely positioned horizontal rollers (not shown) to axially rotate the same as described in U.S. Pat. Nos. 5,571,558, 5,649,988 and 5,725,811 each incorporated herein in its entirety by reference. After allowing polishing chamber 22 to rotate at a specified speed, preferably 50 to 200 revolutions per minute but most preferably 100 revolutions per minute, and for a specified period of time, preferably 2 to 48 hours but most preferably 8 to 36 hours, polishing chamber 22 is removed from the rollers. The rotational speed of the rollers and the duration of the tumbling will vary depending upon the material of IOL 10, the polishing media 78 selected and the degree of smoothness desired. Following polishing, cap 82 is removed from polishing chamber 22 and polishing media 78 is removed therefrom. IOL container 50 may then be removed from polishing chamber 22 and polished IOLs 10 removed from IOL container 50. If free IOLs 10 were placed within polishing chamber 22, the same may be removed and separated from polishing media 78 using an appropriately sized sieve.

The methods for dry polishing IOLs of the present invention are described in still greater detail in the Examples that follow.

EXAMPLE 1

Dry Polishing of Silicone and Hydroview™ Intraocular Lenses

Ten silicone intraocular lenses and ten Hydroview intraocular lenses are obtained for dry polishing in accordance with the present invention. Hydroview lenses are bicomposite lenses having a hydrogel optic portion and polymethylmethacrylate haptics. Two glass polishing chambers tubular in form having a 2-inch internal diameter and 6 inches in length are obtained. One open end of one of the polishing chambers is capped with a plastic cap and the chamber is loaded with an IOL container filled with 10 intraocular lenses and approximately 20 gm of glass beads of 0.4 mm or less diameter. A cap is then used to removably seal the second polishing chamber opening. The polishing chamber once tightly capped is placed horizontally on motorized rollers, or a tumbler. The tumbler is set at 100 revolutions per minute for 36 hours. The IOLs are sampled at the end of 2 hours, 4 hours, 8 hours, 12 hours, 16 hours and 32 hours. The sampled IOLs are analyzed for optic peripheral edge sharpness, haptic polishing using high magnification microscopes.

The method of dry polishing IOLs, as well as the IOLs produced thereby in accordance with the present invention provide a cost-effective means by which multiple IOLs may be simultaneously polished without having to dry or dehydrate the same prior to further processing steps such as applying a consistent surface coating. Additionally, the methods of dry polishing IOLs of the present invention allows the manufacturer to polish an IOL's haptics while maintaining well defined edges on the optic portion thereof. Well-defined optic edges are an important feature to eliminate or minimize the risk of developing posterior capsular opacification of the IOL following implantation.

While there is shown and described herein certain specific methods using specific equipment of the present invention, it will be manifest to those skilled in the art that various modifications may be made without departing from the spirit and scope of the underlying inventive concept and that the same is not limited to the particular forms herein shown and described except insofar as indicated by the scope of the appended claims.

We claim:

1. A method for dry polishing intraocular lenses comprising:

obtaining a polishing chamber with an interior surface defining an internal area and one or more openings;

fixing an intraocular lens container with an exterior surface and an interior surface defining an interior area filled with one or more intraocular lenses portions of which extend beyond said exterior surface for exposure thereof in said internal area of said polishing chamber;

loading at least a portion of said internal area of said polishing chamber with a dry polishing media;

removably sealing said one or more openings; and rotating said polishing chamber to polish said portions of said one or more intraocular lenses exposed to said internal area of said polishing chamber and said polishing media.

2. The method of claim 1 wherein said intraocular lens container remains stationary within said polishing chamber during rotation of said polishing chamber.

3. The method of claim 1 wherein said intraocular lenses are partially enclosed within said intraocular lens container to protect an optic peripheral edge thereof.

4. A method for dry polishing intraocular lenses comprising:

obtaining a polishing chamber with an interior surface defining an internal area and one or more openings;

placing one or more intraocular lenses within said internal area;

loading at least a portion of said internal area of said polishing chamber with a dry polishing media;

removably sealing said one or more openings; and rotating said polishing chamber to polish said intraocular lenses in said internal area of said polishing chamber.

5. The method of claim 1 or 4 wherein said polishing media is selected from the group consisting of glass beads, silica gel, silica and aluminum oxide.

6. The method of claim 1 or 4 wherein said polishing chamber is rotated at a speed of approximately 50 to 200 revolutions per minute.

7. The method of claim 1 or 4 wherein said polishing chamber is rotated at a speed of approximately 100 revolutions per minute.

8. The method of claim 1 or 4 wherein said polishing chamber is rotated for a period of time of approximately 2 to 48 hours.

9. The method of claim 1 or 4 wherein said polishing chamber is rotated for a period of time of approximately 8 to 36 hours.

10. An intraocular lens produced using the method of claim 1 or 4.

11. An intraocular lens holder for use in conjunction with an intraocular lens dry polishing system comprising:

a tubular body portion with one open loading end;

one or more elongated slots in said tubular body portion extending from said open loading end to accommodate extension of intraocular lens haptics therethrough;

retaining disks for protection of intraocular lens optics; and closure means to removably close said open loading end.

12. The intraocular lens holder of claim 11 wherein said tubular body portion is made from a material selected from the group consisting of glass, plastic and metal.

13. The intraocular lens holder of claim 11 wherein said retaining disks are manufactured from a material selected from the group consisting of natural rubber, synthetic rubber, and plastic.

14. The intraocular lens holder of claim 11 wherein said tubular body portion is sized to accommodate a plurality of intraocular lenses.

15. The intraocular lens holder of claim 11 wherein extended clamps are formed on an exterior surface of said tubular body portion to allow said tubular body portion to be fixed within a polishing chamber.

16. An intraocular lens produced using the intraocular lens holder of claim 11.

17. An intraocular lens dry polishing system comprising:

an intraocular lens holder formed from a tubular body portion with one open loading end;

one or more elongated slots in said tubular body portion extending from said open loading end to accommodate extension of intraocular lens haptics therethrough;

retaining disks sized for placement within said tubular body portion to protect intraocular lens optics;

closure means to removably close said open loading end;

extended clamp means on an exterior surface of said tubular body portion;

a polishing chamber with an open end sized to accommodate placement of said intraocular lens holder containing one or more intraocular lenses in an interior area defined by an interior surface of said polishing chamber;

retaining means formed on said interior surface of said polishing chamber removably engageable with said extended clamp means to fix intraocular lens holder within said polishing chamber;

polishing media filling at least a portion of said interior area of said polishing chamber; and closure means to removably close said open end of said polishing chamber.

18. An intraocular lens produced using the system of claim 17.

19. The intraocular lens dry polishing system of claim 17 wherein said polishing media is selected from the group consisting of glass beads, silica gel, silica and aluminum oxide.

20. The intraocular lens dry polishing system of claim 17 wherein said tubular body portion is sized to accommodate a plurality of intraocular lenses.

21. The intraocular lens dry polishing system of claim 17 wherein rotation of said polishing chamber causes repeated contact of said intraocular lens haptics with said polishing media to polish said intraocular lens haptics.

* * * * *